United States Patent [19]

Lionetti et al.

[11] 4,443,551

[45] Apr. 17, 1984

[54] METHOD AND NEW DISTRIBUTOR FOR DELIVERING HIGH VELOCITY GAS FROM A GAS DISTRIBUTOR THROUGH A NOZZLE WITH DECREASED EROSION IN THE NOZZLE

[75] Inventors: Thomas A. Lionetti, Houston; John P. MacLean, Stafford, both of Tex.

[73] Assignee: Texaco Inc., White Plains, N.Y.

[21] Appl. No.: 338,763

[22] Filed: Jan. 11, 1982

[51] Int. Cl.[3] ..... B01J 29/38; C10G 11/18; F27B 15/10; F23L 5/00

[52] U.S. Cl. ..... 502/41; 34/57 R; 208/163; 208/164; 239/548; 239/558; 239/601; 422/143; 422/144

[58] Field of Search ..... 252/417; 208/164, 163; 34/57 R; 502/41–43

[56] References Cited

U.S. PATENT DOCUMENTS

| | | | |
|---|---|---|---|
| 2,608,474 | 8/1952 | Gilliam | 252/417 |
| 3,466,021 | 9/1969 | Van Weert et al. | 263/21 |
| 3,647,714 | 3/1972 | White | 252/417 |
| 3,680,349 | 8/1972 | Horton | 72/316 |
| 3,890,111 | 6/1975 | Knudson | 252/417 |
| 3,927,479 | 12/1975 | Stephanoff | 34/57 R |
| 3,974,091 | 8/1976 | Parker et al. | 252/417 |
| 4,051,069 | 9/1977 | Bunn, Jr. et al. | 252/417 |
| 4,223,843 | 9/1980 | Smith et al. | 239/558 |
| 4,322,384 | 3/1982 | Sutton | 422/144 |

*Primary Examiner*—P. E. Konopka
*Attorney, Agent, or Firm*—Jack H. Park; Theron H. Nichols; Richard A. Morgan

[57] ABSTRACT

A method as described in the title comprising deflecting the gas from the distributor through nozzles therein through an angle in the range of 30° to 75° for decreased erosion in the nozzles by solids drawn therein and for reduced required power consumption. A new gas distributor with nozzles mounted therein is disclosed.

9 Claims, 5 Drawing Figures

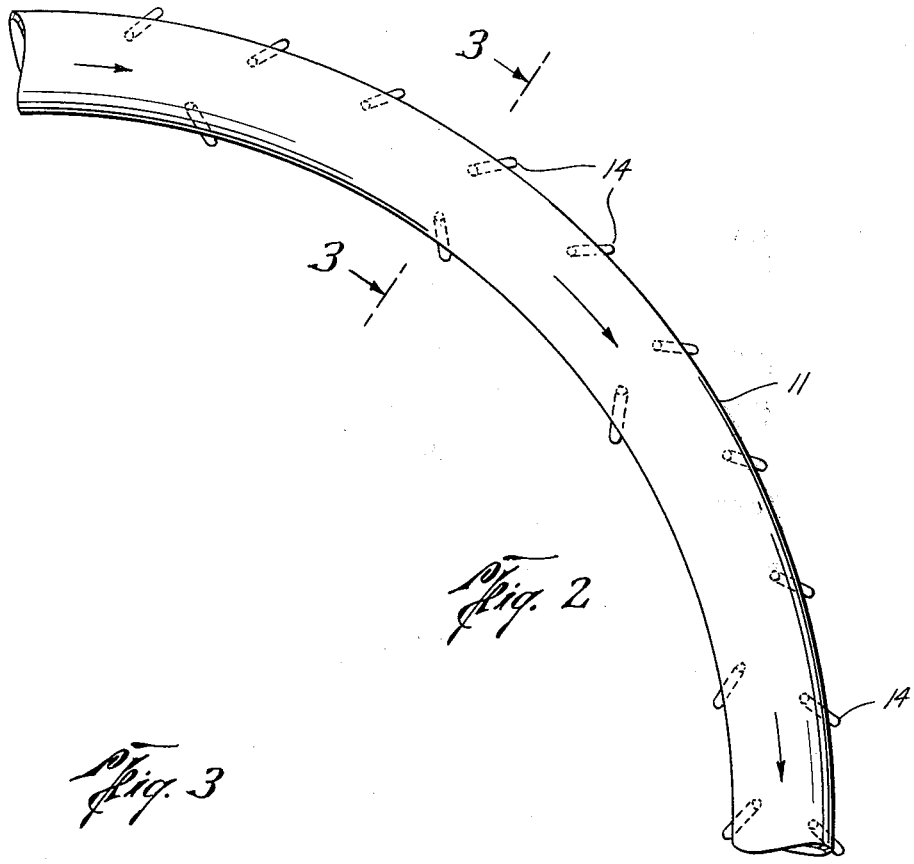
Fig. 2
Fig. 3
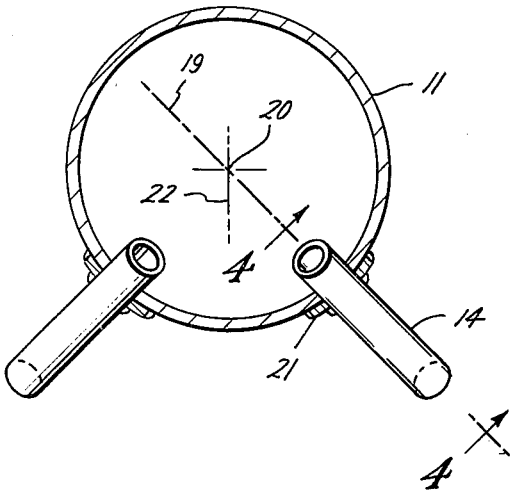
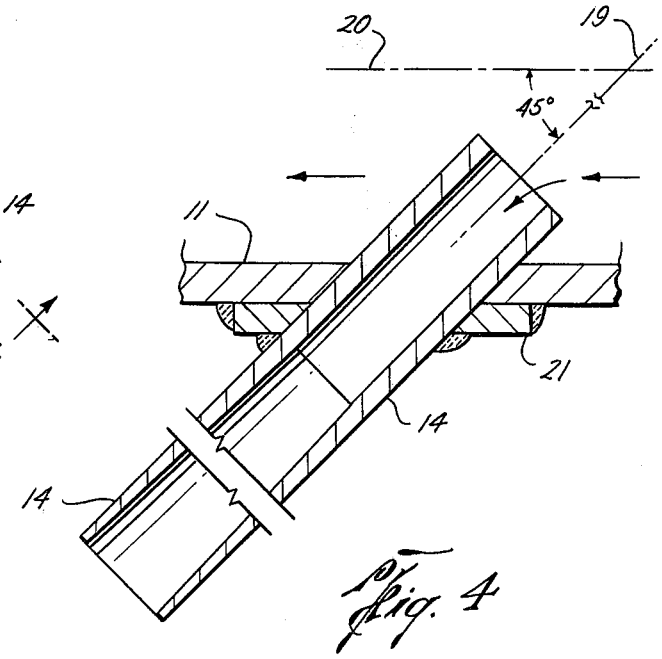
Fig. 4

METHOD AND NEW DISTRIBUTOR FOR DELIVERING HIGH VELOCITY GAS FROM A GAS DISTRIBUTOR THROUGH A NOZZLE WITH DECREASED EROSION IN THE NOZZLE

BACKGROUND OF THE INVENTION

Current fluid catalytic cracking unit air rings have their nozzles mounted therein at a 90° angle to the air ring and to the main body of air flow therein as illustrated in FIG. 1 of assignee's U.S. Pat. No. 4,223,243 and in U.S. Pat. No. 2,798,030. Great amounts of nozzle erosion have resulted from this type of nozzle installation, especially when the air flow rates drop to lower than design air flow rates. It is hypothesized that this erosion is caused by pressure differences within the nozzles, wherein as the air ring air flow makes its 90° turn into the nozzle, air flow is directed against the outside portion of the nozzle for the length thereof resulting in a low pressure area formed on the other or inner side of the turn as the high velocity air makes the 90° turn into the nozzle, the low pressure being most pronounced in the upstream portion of the nozzle. This low pressure area is deemed, in the present example, to draw catalyst from the regenerator up into the nozzle and then to circulate within the nozzle, causing erosion of the nozzle internal surface.

OBJECTS OF THE INVENTION

Accordingly a primary object of this invention is to provide a method for delivering a high velocity gas from a gas distributor through a nozzle therein with decreased erosion in the nozzle by foreign material.

Thus, a further primary object of this invention is to provide a method for delivering a high velocity oxygen-carrying gas from a gas distribution lance or ring to a zone of spent catalyst in a regenerator in a fluid catalytic cracking process having decreased erosion in the nozzle by catalyst drawn up from the regenerator.

Another primary object of this invention is to provide an air distributor with nozzles having decreased erosion therein.

A further object of this invention is to provide an air distributor having nozzles that is easy to operate, is of simple configuration, is economical to build and assemble, and is of greater efficiency for the supplying of air to a fluidized bed.

Other objects and various advantages of the disclosed method for decreasing erosion in a nozzle and a novel gas distributor having nozzles therein will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWING

The drawing diagrammatically illustrates by way of example, not by way of limitation, one form of the invention wherein like reference numerals designate corresponding parts in the several views in which:

FIG. 2 is a schematic diagrammatic horizontal sectional view of a portion of the new and improved air ring and nozzle combination, taken of 2—2 on FIG. 1;

FIG. 3 is a section taken at 3—3 on FIG. 2;

FIG. 4 is a section taken at 4—4 on FIG. 3; and

Figure 1:
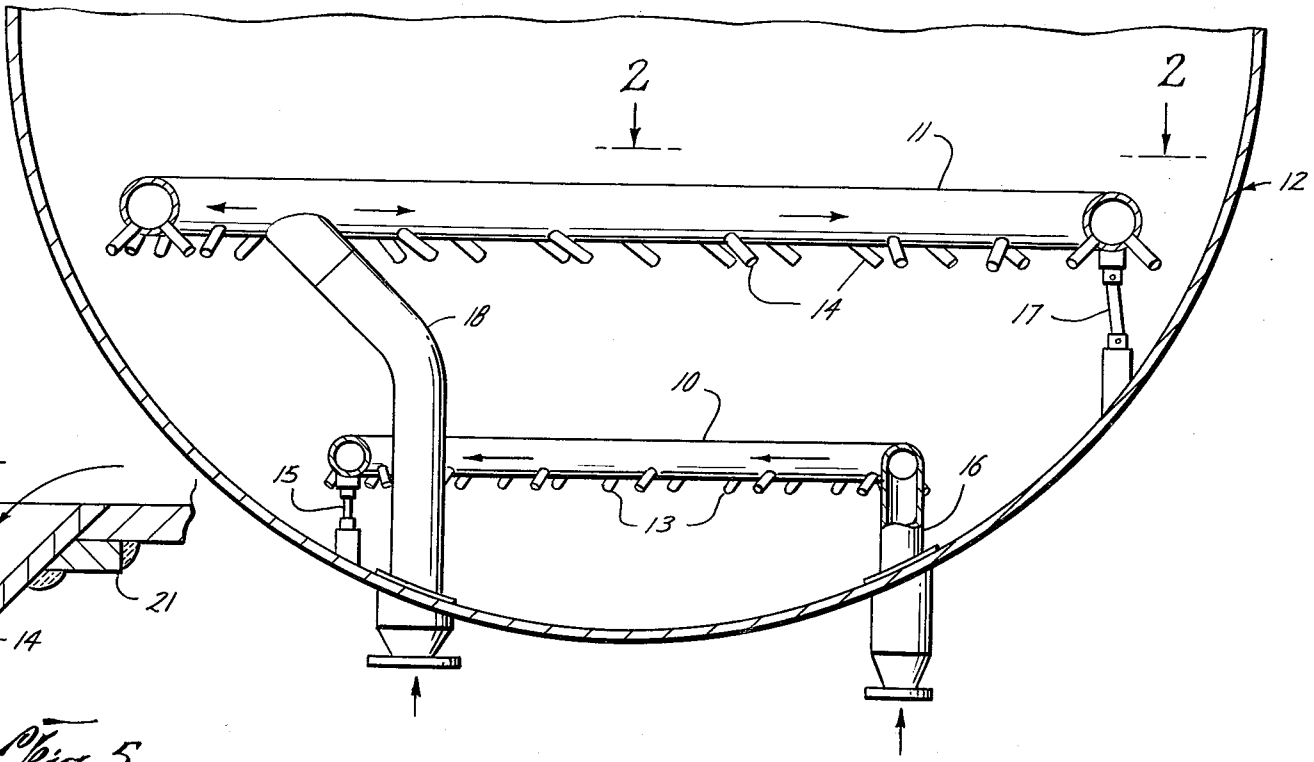
FIG. 1 is a schematic diagrammatic vertical sectional view of a portion of an inventors' air distributor in the form of an air ring with the new nozzles mounted therein at a 45° angle to the flow of air in the air ring.

The invention disclosed herein, the scope of which being defined in the appended claims is not limited in its application to the details of construction and arrangement of parts shown and described, since the invention is capable of being in the form of other embodiments and of being practiced or carried out in various other ways. Also, it is to be understood that the phraseology or terminology employed here is for the purpose of description and not of limitation. Further, many modifications and variations of the invention as hereinafter set forth will occur to those skilled in the art. Therefore, all such modifications and variations which are within the spirit and scope of the invention herein are included and only such limitations should be imposed as are indicated in the appended claims.

DESCRIPTION OF THE INVENTIONS

This patent includes two inventions, a method for decreasing erosion in the nozzles in an air ring or lance type of air distributor in a fluid catalytic cracking unit and a mechanism for practicing the above method comprising a nozzle mounted in an air distributor at an angle to the air flow therein the range of 30° to 75°.

METHOD FOR DECREASING EROSION IN AN AIR RING NOZZLE

A new method has been invented for delivering a high velocity oxygen-carrying gas from a gas distributor to a zone of spent catalyst in a regenerator in a fluid catalyst in a regenerator in a fluid catalytic cracking process comprising the two steps of, (1) Flowing the high velocity gas through a gas distribution ring (10 or 11) to nozzles (13 or 14) therein, and (2) Deflecting the oxygen-carrying gas from the gas distribution ring to the nozzles through an angle in the range of 30° to 75° for decreased erosion in the nozzles by the catalyst drawn up from the regenerator.

Another method for delivering high velocity air from an air ring (10 or 11) to a nozzle (13 or 14) therein in a regenerator in a fluid catalytic cracking process comprising, (1) Diverting the air from the air ring to the nozzle through an angle in the range of 30° to 75° for decreased erosion in the nozzle by catalyst drawn up from the regenerator.

A further method for passing high velocity air from an air ring (10 or 11) to a nozzle (13 or 14) in the air ring comprises, (1) Passing the air to the nozzle (13 or 14) from the air distributor (10 or 11) through an angle in the range of 30° to 75° for decreased erosion in the nozzle.

Still further, a method is recited for decreasing erosion in a nozzle comprising, (1) Diverting high velocity gas at an angle in the range of 30° to 75° from a gas source into the nozzle attached to the gas source.

Another method comprises methods similar to those above except that the last method step comprises, (1) Performing the method step through an angle in the preferable range of 45° to 60°.

Thus, a few methods are described above for greatly decreasing erosion in nozzles for supplying a fluid from a fluid supply conduit.

DESCRIPTION OF AN APPARATUS

While various devices may be utilized for carrying out or practicing the above inventive methods, FIGS. 1–4 illustrate at least one inventive apparatus for practicing the methods described above.

FIG. 1 shows the new air distributors, such as but not limited to, air rings 10 and 11 for use in a regenerator 12 with nozzles 13 and 14, respectively, therein protruding from the air ring at a 45° angle to the flow of air in the air ring as distinguished from the 90° angle shown in Assignee's U.S. Pat. No. 4,223,843 drawn to a typical "Air Distribution Apparatus". While ring shaped air distributors are shown for illustration, lance type may be utilized if so desired or required.

The U.S. Pat. No. 2,798,030 discusses the nozzle erosion problem in column 1, second paragraph, and how it was at least partially solved with a different shaped nozzle. Inventors' new nozzle angle is deemed to be the cause of the surprising result of a dramatic decrease in erosion internally of the nozzles, apparently caused by the catalyst being drawn up from the regenerator. This angle may vary from 30° to 75°, and preferably, an angle between 45° and 60° is most desired.

In the regenerator 12 of FIG. 1, inner air distribution ring 10 mounted therein on a plurality of struts, as strut 15 illustrated, and with high velocity air duct 16 mounted radially on the air ring 10 and supplied from a high pressure air manifold (not shown) for passing the high pressure air to the air distribution ring 10 for being distributed around the bottom in the regenerator through the nozzles 13 for maintaining the catalyst fluidized in a fluidized bed.

Upper and outer air distribution ring 11 is likewise supported from the bottom of the regenerator with struts, such as with the illustrated strut 17, FIG. 1, and connected to a high pressure air supply duct 18. Angled nozzles 14 are likewise mounted on outer air ring 11 at a 45° angle to the flow of air through the ring whereby the high pressure high velocity air makes a 45° angle change of direction prior to being ejected into the catalyst fluidized bed.

While the gas described in the enclosed example is air, obviously other gases may be utilized for being ejected by the nozzles.

And while the disclosed gas nozzle is described as being designed for use in a regenerator for regeneration of catalyst in an oil refinery, obviously other uses may be made of the disclosed angled gas ejecting nozzles where the erosion of nozzles is a problem.

FIG. 2, a section taken at 2—2 on FIG. 1, illustrates the position of the nozzles 14 on air supply ring 11 being between 30° and 75° and preferably between 45° and 60° from the direction of flow at the nozzle entrance so that the fluid flow is deviated 45°, for example, from the flow path in the ring 11. Thus, the result is decreased erosion in the nozzles by the catalyst drawn up from the regenerator and less tendency of aspirating catalyst up the nozzle.

FIG. 3, a section at 3—3 on FIG. 2 illustrates two nozzles 13 protruding from air ring 10 at 45° from a vertical plane through the air supply ring axis. This angle may vary, depending on the particular air pressure and design requirements, but the nozzle should lie in a plane through the central axis of the column of supply air at the nozzle, deviated from the central axis at an angle between 30° and 75°, and preferably between 45° and 60°.

FIG. 4, a section of 4—4 on FIG. 3 illustrates the new critical angle between a nozzle 14 on air ring 11 and the flow of supply air in the air ring at the nozzle or the angle between the central axis 19 of the nozzle 13 and the central axis 20 of fluid flow of the air supply ring 10 of the air flow therein at the nozzle.

Since the nozzle requires a particular length to establish stabilized flow therethrough, in this modification the nozzle inlet end protrudes into the air distributor as illustrated, particularly when the air ring is mounted close to the regenerator well.

Figure 5:
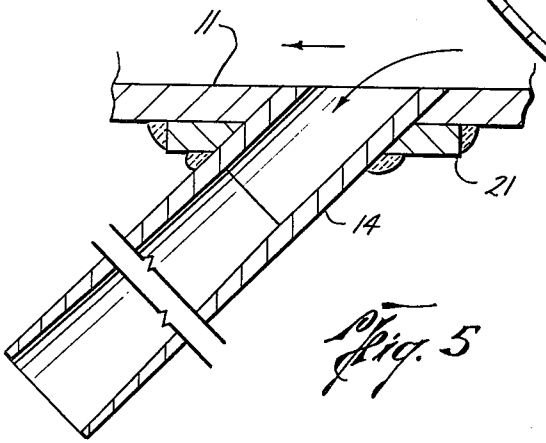
FIG. 5 is a modification of FIG. 4.

FIG. 5 is a modified gas distributor and nozzle combination wherein the nozzle is extended out of the air distributor as far as possible with the nozzle entrance being flush with the inner surface of the air distributor.

The nozzles 13 and 14, FIG. 1, may be mounted on their respective air rings 10 and 11 by welding as follows. A cylindrically shaped plate 21, FIG. 4, is welded to the air ring after being centered over the planned location of a nozzle. A hole is then drilled through both the plate and the air ring wall at the required point of location on the air ring wall and at the required angle defined above. The longitudinal axis of the hole and the axis 19 of the nozzle when inserted therein are congruent with each other and thus pass through the longitudinal axis 20 of fluid flow of the air ring 11. As viewed in FIG. 3, the angle of the plane through the nozzle axis 19 and through the fluid flow axis 20 of the ring at the nozzle with the vertical plane 22 through the air ring fluid flow longitudinal axis 20 of the nozzle may be dictated by the exit velocity of the ejected fluid from the nozzle and design requirements, it being shown here as about 45°. The critical angle is that illustrated in FIG. 4. This important angle is that between the longitudinal axis 20 of fluid flow and the longitudinal axis 19 of the nozzle 14. This angle must be between 30° and 75° and preferably between 45° and 60°, it being shown at the preferred angle of 45° on FIG. 4. This is the angle through which the gas in the gas supply distributor or air ring must turn or deviate through as it enters and passes through the nozzles.

In air nozzle operation, there are more objectives which are fulfilled which thus form additional advantages:

(A) Maintain a certain minimum pressure drop through each nozzle (as a percentage of the pressure drop of the bed above the nozzle) to maintain stable flow and operation within the nozzle. If the minimum pressure drop is not satisfied, enough nozzles will shut themselves down (i.e., plug off with catalyst) to get that minimum pressure drop in the remaining open nozzles. Shutting down of several nozzles is undesirable because it may enable catalyst to enter the distributor (thus contributing to erosion and attrition) and it may lead to maldistribution of gas within the bed.

(B) The second objective that is fulfilled is to not exceed some maximum gas exit velocity out of the nozzles. If velocity out of the nozzle is too high, catalyst attrition will be excessive.

In air distributor design, there are two objectives (A & B) that will constrain the distributor's range of operability. The prior disclosure of tapered nozzles (90°) affects constraint by making the outlet velocity lower for a given pressure drop. The 45°–60° angle flow diverting design also makes the nozzles self-clearing. The present invention will affect constraint A above. It is hypothesized that the minimum pressure drop requirement to keep all nozzles open will be reduced because there is a velocity component in the direction of air distributor flow which will be transmitted into the air nozzles. Such velocity component would not be in evidence for the standard design, where nozzles are installed at 90° to the flow. Thus, the present invention would increase the range of operability for the air distributor in which both the velocity maximum and the pressure drop minimum are satisfied.

Further, this invention could be especially useful in the area of energy conservation for two reasons.

(A) During turndown operation, the air rates to the distributor could be reduced more than is currently done, while still maintaining adequate and stable distributor operation. This would save on air compressor power costs.

(B) The reduced requirement for minimum pressure drop thru nozzles would allow running the air compressor at slightly lower outlet pressure at normal operation, again reducing power consumption.

Another advantage of this new air distributor nozzle combination is reduced required power consumption as explained in greater detail:

The nozzles are formed with tapered walls toward the outer end of the nozzle for forming a diverging nozzle for increased flow of fluid at a decreased velocity as taught in Assignee's Pat. No. 4,223,843. The greatest range of turning of the flow of fluid from the air supply distributor lance or ring through the nozzle is between 30° and 75°, with the preferable range being 45° to 60°, and preferably at the angle of 45°.

Accordingly, it will be seen that the disclosed method for delivering high velocity air from an air distributor to a nozzle therein and the new air distributor lance or ring with a nozzle mounted therein will operate in a manner which meets each of the objects set forth hereinbefore.

While only a few methods of the invention and two mechanisms for carrying out the methods have been disclosed, it will be evident that various other methods and modifications are possible in the arrangement and construction of the disclosed methods and apparatus without departing from the scope of the invention and it is accordingly desired to comprehend within the purview of this invention such modifications as may be considered to fall within the scope of the appended claims.

We claim:

1. A method for delivering a high velocity oxygen-carrying gas from a gas distributor to a zone of spent catalyst in a regenerator in a fluid catalytic cracking process comprising, (a) flowing the high velocity oxygen-carrying gas through a gas distributor downward to nozzles therein, and (b) deflecting the oxygen-carrying gas from the distributor to the nozzles downward and through an angle in the range of 30° to 75° to the flow of gas in the gas distributor for decreased erosion in the nozzles by catalyst drawn up from the regenerator and for reduced required power consumption.

2. A method for delivering high velocity air from an air distributor to a nozzle therein in a regenerator in a fluid catalytic cracking process comprising, (a) diverting the air from the air distributor to the nozzle downward and through an angle in the range of 30° to 75° to the flow of air in the air distributor for decreased erosion in the nozzle by catalyst drawn up from the regenerator and for reduced required power consumption.

3. A method as recited in claims 1 or 2, wherein the last method step comprises, (a) performing the method step through an angle in the range of 45° to 60°.

4. A method for delivering a high velocity oxygen-carrying gas from a gas distributor to a zone of spent catalyst in a regenerator in a fluid catalytic cracking process comprising, (a) flowing the high velocity oxygen-carrying gas through a gas distributor to nozzles therein, and (b) deflecting the oxygen-carrying gas from the distributor to the nozzles through an angle in the range of 30° to 75° to the flow of air in the distributor and 30° to 75° downward from the horizontal.

5. The method of claim 4 wherein the oxygen-carrying gas is deflected through an angle of 45° to 60° to the flow of air in the distributor and 45° to 60° downward from the horizontal.

6. The method of claim 4 wherein the oxygen-carrying gas is deflected through an angle of 45° to the flow of air in the distributor and 45° downward from the horizontal.

7. A method for delivering high velocity air from an air distributor to a nozzle therein in a regenerator in a fluid catalytic cracking process comprising, (a) diverting the air from the air distributor to the nozzle through an angle in the range of 30° to 75° to the flow of air in the distributor and 30° to 75° downward from the horizontal.

8. The method of claim 7 wherein the air is diverted through an angle in the range of 45° to 60° to the flow of air in the distributor and 45° to 60° downward from the horizontal.

9. The method of claim 7 wherein the air is diverted through an angle of 45° to the flow of air in the distributor and 45° downward from the horizontal.

* * * * *